United States Patent [19]

Schuck

[11] 4,400,049

[45] Aug. 23, 1983

[54] CONNECTOR FOR INTERCONNECTING CIRCUIT BOARDS

[75] Inventor: David B. Schuck, Escondido, Calif.

[73] Assignee: NCR Corporation, Dayton, Ohio

[21] Appl. No.: 292,309

[22] Filed: Aug. 12, 1981

[51] Int. Cl.[3] ..... H01R 13/62

[52] U.S. Cl. ..... 339/176 MP; 339/17 LM; 339/205; 339/217 R

[58] Field of Search ..... 339/17 LC, 17 LM, 17 M, 339/75 MP, 176 MP, 204, 205, 217 R

[56] References Cited

U.S. PATENT DOCUMENTS

| | | | |
|---|---|---|---|
| 3,243,761 | 3/1966 | Piorunneck | 339/217 R |
| 3,526,869 | 1/1969 | Conrad et al. | 339/176 MP |
| 3,771,100 | 11/1973 | Reed | 339/176 MP |
| 4,021,091 | 5/1977 | Anhalt et al. | 339/75 MP |
| 4,080,027 | 3/1978 | Benasutti | 339/75 MP |
| 4,220,382 | 9/1980 | Richie et al. | 339/17 LM |
| 4,327,955 | 5/1982 | Minter | 339/75 MP |

FOREIGN PATENT DOCUMENTS

| | | | |
|---|---|---|---|
| 1491217 | 11/1977 | United Kingdom | 339/217 R |

*Primary Examiner*—John McQuade
*Assistant Examiner*—Gary F. Paumen
*Attorney, Agent, or Firm*—J. T. Cavender; Edward Dugas; Stephen F. Jewett

[57] ABSTRACT

A connector for connecting coplanar circuit boards in an edge-to-edge fashion. The connector has a housing with a circuit board receiving cavity extending through and between opposite faces of the housing. The cavity has two opposing side walls which support electrical terminals for contacting conductors on the edges of circuit boards that are inserted into the cavity at the opposing faces of the housing. A passage extends transversely through the housing and intersects the cavity and receives a pin for engaging the terminals and maintaining them fixed within the housing. The edge-to-edge connection of two or more coplanar circuit boards is provided by use of the connector.

7 Claims, 5 Drawing Figures

CONNECTOR FOR INTERCONNECTING CIRCUIT BOARDS

BACKGROUND OF THE INVENTION

The present invention relates to electrical connectors, and, more particularly, to an electrical connector for interconnecting circuit boards.

Printed circuit boards are used widely in order to mount and interconnect electrical components in all types of electronic equipment, including data processing systems. In a data processing system, printed circuit boards are often inserted into connectors located along a computer backpanel so that conductors on each of the printed circuit boards may be electrically interconnected, by way of the connectors, at the backpanel.

One frequent occurrence in the use of a data processing system is the need for additional circuitry, such as memory circuitry or devices, in order to increase the capacity of the data processing system. In the past, this was accomplished by increasing the number of circuit boards connected to the computer backpanel. If the computer backpanel was already fully occupied, it was necessary to redesign the entire system, for example, by replacing the old backpanel with a larger backpanel in order to permit a larger number of circuit boards to be interconnected at the backpanel.

Obviously, the replacement of a backpanel because it is not of sufficient size to permit the connection of additionally circuit boards significantly increases the cost of adding to the capacity of a data processing system.

There has, therefore, arisen the need for an apparatus which permits increasing the number of printed circuit boards in a data processing system without having to either replace a backpanel which interconnects such circuit boards or leave sufficient room on an existing backpanel so that additional printed circuit board may be later connected. There has further arisen the need for such an apparatus that can be inexpensively manufactured and easily assembled.

SUMMARY OF THE INVENTION

There is provided, in accordance with the present invention, a printed circuit board connector for electrically interconnecting, edge-to-edge, two or more coplanar printed circuit boards. In particular, the connector in accordance with the present invention includes a housing with two oppositely directed faces, with each face having an opening for receiving a printed circuit board so that two coplanar printed circuit boards having confronting edges may be received at the openings on the oppositely directed faces and may be electrically interconnected at the connector.

In the disclosed preferred embodiment, the described circuit board connector comprises a one-piece molded housing having oppositely directed faces or ends with openings for receiving the edges of two coplanar printed circuit boards. The openings communicate to form a printed circuit board receiving cavity. The printed circuit board receiving cavity has two opposing walls with electrical terminals arranged on each of the opposing walls. Means for supporting the terminals, in the form of uniformly-spaced ledges on the opposing walls, maintain the terminals in spaced relation along each of the opposing walls. Each terminal has two contact ends, with the contact ends contacting conductors on the inserted printed circuit boards so that each conductor on one printed circuit board is electrically connected to a conductor on the other circuit board.

In order to maintain or hold the terminals on the opposing walls so that printed circuit boards received in the cavity may be inserted between the contact ends of the terminals on one of the opposing walls and the contact ends of the terminals on the other of the opposing walls, the connector housing includes a transverse passage extending through the housing and intersecting the cavity. A terminal engaging pin is inserted into the passage when the connector is assembled, so that the pin passes between the terminals on one of the opposing walls and the terminals on the other of the opposing walls. The pin engages each of the terminals and maintains the terminals in a fixed position on the opposing walls. When circuit boards are inserted into the connector at the openings on the oppositely directed faces of the connector housing, the contact ends of the terminals make physical and electrical contact with the conductors on each side of the inserted circuit boards.

It should be apparent that, by providing a connector that permits edge-to-edge connection of coplanar circuit boards, a means is provided for increasing the number of circuit boards in a data processing system without having to electrically connect such additional circuit boards to a computer backpanel. In particular, when a circuit board having additional memory or other circuit devices is to be added to the system, such circuit board can be directly connected, in an edge-to-edge fashion, to an existing circuit board rather than being connected by way of the computer backpanel.

Furthermore, the construction of the connector and, in particular, the provision of the terminal engaging pin in order to maintain the terminals fixed within the connector housing, permits the connector to be both inexpensively manufactured and easily assembled.

It is, therefore, an object of the present invention to provide an improved data processing system which permits the addition of printed circuit boards with minimal cost.

Another object of the present invention is to provide an inexpensive and easily assembled printed circuit board connector for use in a data processing system.

Still another object of the present invention is to provide an improved printed circuit board connector which permits edge-to-edge electrical interconnection of printed circuit boards.

Yet another object of the present invention is to provide a printed circuit board connector which permits direct electrical interconnection of printed circuit boards without the use of a computer backpanel.

These and other objects of the present invention will become apparent when taken in conjunction with the following description and the attached drawings.

DETAILED DESCRIPTION OF THE PREFERRED EMBODIMENTS

Figure 1:
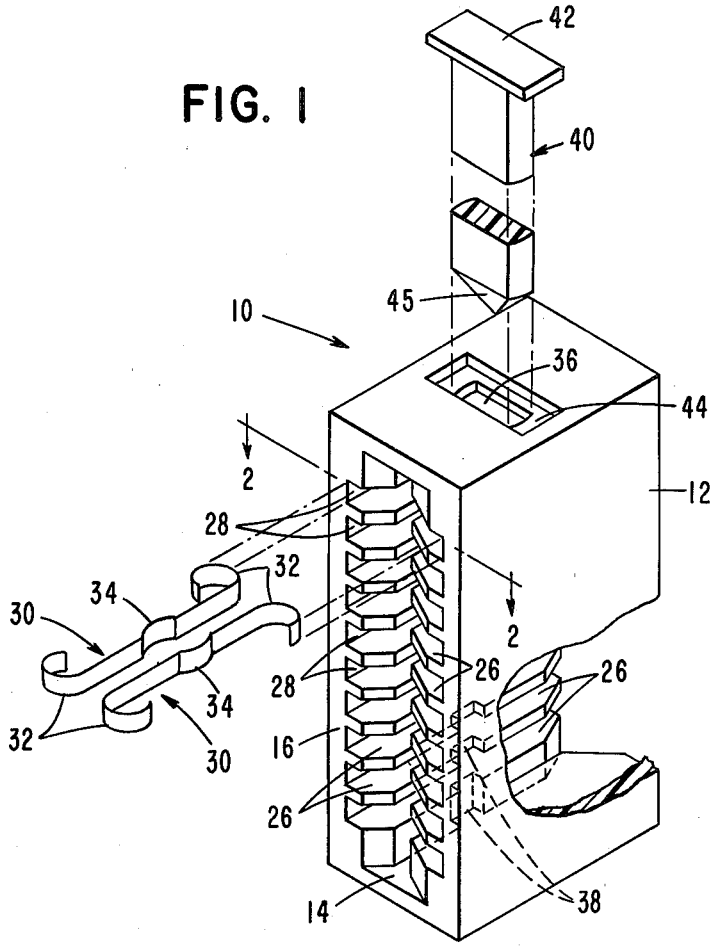
FIG. 1 is an exploded perspective view, with portions removed, illustrating the connector of the present invention.
Figure 2:
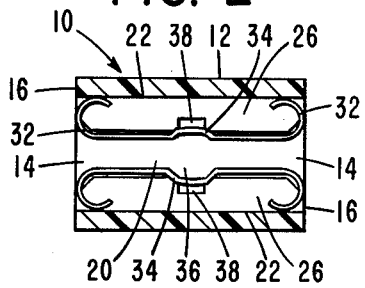
FIG. 2 is a sectional view taken along the line 2—2 of FIG. 1, illustrating the connector prior to insertion of the terminal engaging pin.
Figure 3:
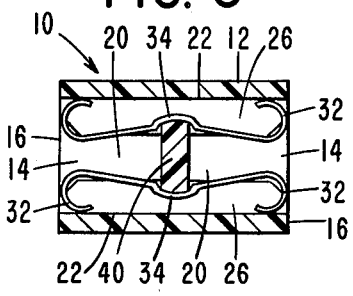
FIG. 3 is the same view as FIG. 2, but after insertion of the terminal engaging pin.

Referring now to FIGS. 1, 2 and 3, there is shown a connector 10 in accordance with the present invention. The connector 10, as will be more fully described later, receives and electrically connects two printed circuit boards. The connector 10 has a connector housing 12 and printed circuit board receiving openings 14 on opposing ends or faces 16 of the housing.

As seen best in FIGS. 2 and 3, the openings 14 on the opposing faces 16 of the connector housing 12 communicate to form a printed circuit board receiving cavity 20 into which a printed circuit board (not shown in FIGS. 1 2 or 3) is inserted at each of the openings 14 for purposes of making electrical interconnections. The cavity 20 within the housing 12 has opposing side walls 22, with uniformly-spaced terminal supporting ribs or ledges 26 formed on each of the side walls 22. The ledges 26 cooperate with the side walls 22 to form slots 28 (FIG. 1) on each of the side walls 22 into which are received conductive spring terminals 30. Each terminal 30 has two curved contact ends 32 for making physical and electrical contact with conductors on the printed circuit boards that are inserted in the connector 10. Each terminal 30 also has an outwardly bent or dimpled portion 34 centrally located between the contact ends 32.

The connector 10 further includes a transversely extending passage 36 that passes through the housing 12, from top to bottom, and that intersects the cavity 20. As seen best in FIG. 2, and as illustrated with respect to some of the ledges 26 along only one of the side walls 22 in FIG. 1, the passage 36 is formed at each of the ledges 26 by a notch 38. The passage 36 has a generally rectangular cross-sectional shape for receiving a correspondingly shaped terminal engaging pin 40. The pin 40 has an enlarged rectangular head 42 at one end that seats in a correspondingly shaped recess 44 at the top of the housing 12 when the pin 40 is fully inserted into the passage 36. The pin 40 also has tapering surfaces 45 at its other end for ease of insertion of the pin into the passage 36.

When the connector 10 is to be assembled, the terminals 30 are inserted into the slots 28 at one of the faces 16 so that the terminals are supported on the opposing side walls 22 within the cavity 20 by the ledges 26. Then, as seen best in FIG. 3, the pin 40 is inserted into the passage 36, and it passes through the length of the cavity 20 between the side walls 22 and engages each of the terminals 30 at its dimpled portion 34. The engagement of the pin 40 at each dimpled portion 34 centers the terminals 30 in the housing and also biases the terminals 30 outwardly in order to maintain the terminals locked or fixed in position and to assure good electrical contact between the inserted circuit boards and the contact ends 32.

It should be apparent from the foregoing description that the connector 10 can be both inexpensively manufactured and easily assembled. The connector housing 12 and the pin 40 can each be molded from plastic as single pieces and the terminals 30 can be easily inserted into the housing 12 prior to insertion of the pin 40. The terminals 30, while supported by the ledges 26, remain loose until the pin 40 is inserted. When the pin is inserted, the terminals 30 are locked in place. When a printed circuit board is inserted into the connector 10, conductors on the edge of the circuit board contact the contact ends 32 at each of the terminals 30 with a wiping action, and the pin 40, which then occupies the passage 36 and extends across the cavity 20, acts as a stop against which the circuit board abuts in order to prevent the circuit board from being inserted too far into the cavity 20.

Figure 4:
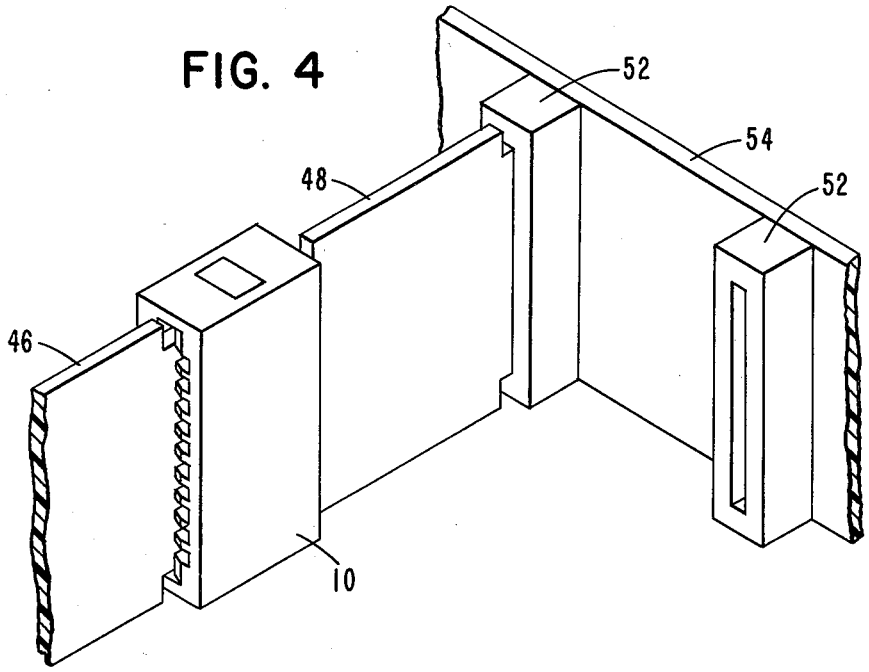
FIG. 4 is a fragmentary perspective view illustrating the addition of a circuit board directly to an existing circuit board at a computer backpanel, using a connector in accordance with the present invention.

In FIG. 4, there is illustrated the edge-to-edge connection of two coplanar printed circuit boards 46 and 48 by the connector 10 of FIGS. 1, 2 and 3. The printed circuit board 48 is shown in FIG. 4 as one of several boards that are connected by conventional connectors 52 to a computer backpanel 54. For example, the board 48 could be a printed circuit board having memory devices (not shown) mounted thereon and electrically connected to other components of a large data processing system by the backpanel 54. As noted earlier, in the past, when additional boards were to be added to a data processing system, it was necessary either to leave sufficient room on the backpanel 54 for the connection of the additional circuit boards thereto, or to replace the backpanel 54 with a larger backpanel having enough room for connection of the additional circuit boards.

In the arrangement shown in FIG. 4, however, the connector 10 permits the connection of the circuit board 46, which might represent a circuit board having additional memory devices, directly to the circuit board 48 rather than the backpanel 54. Of course, the circuit board 48 must have conductors suitably formed at both the edge inserted into connector 52 and the edge inserted into connector 10. Conductors on the edge of the circuit board 46 that is inserted into the connector 10 are electrically connected, by the terminals 30 in the connector 10, to the conductors on the edge of circuit board 48 that is inserted into connector 10.

While not shown in the drawings, it should be appreciated that the connector 10 could also be used to expand the backpanel 54 by electrically interconnecting, in an edge-to-edge fashion, a second backpanel to the backpanel 54.

Figure 5:
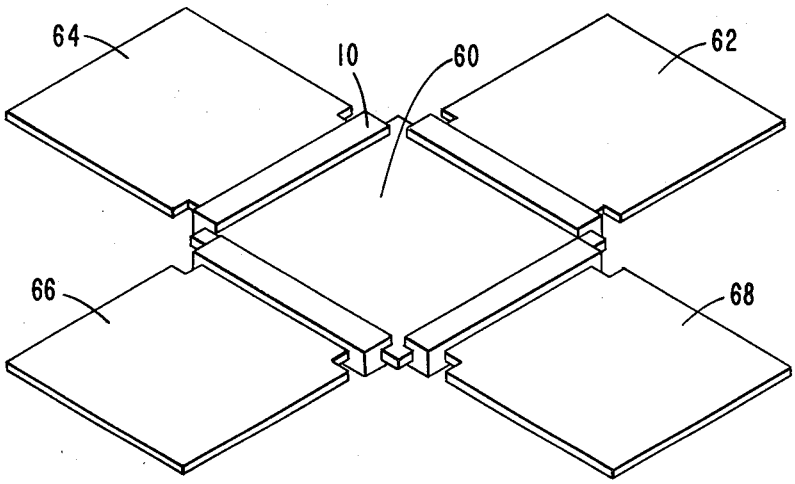
FIG. 5 is a perspective view illustrating the interconnection of five circuit boards using connectors in accordance with the present invention.

Finally, in FIG. 5, there is illustrated an alternate use of the connector 10 in accordance with the present invention. As can be seen in FIG. 5, one connector 10 is connected to each of the four sides or edges of a central circuit board 60. Four circuit boards 62, 64, 66 and 68 that are coplanar with the circuit board 60 are then interconnected at circuit board 60 by inserting one of those boards in each of the connectors 10. It should be apparent that in a data processing system requiring plural boards and the interconnections of such boards, the arrangement seen in FIG. 5 would permit the boards to be arranged in a coplanar fashion and to be interconnected by the connectors 10 and conductors on the central circuit board 60, without the use of a backpanel such as the backpanel 54 seen in FIG. 4.

Although the preferred embodiments of the present invention have been described, it will be understood that within the purview of the present invention various changes may be made within the scope of the appended claims.

I claim:

1. A connector for receiving confronting edges of two coplanar circuit boards and electrically interconnecting said circuit boards, said connector comprising:

a connector housing having oppositely directed faces, an elongated opening of each of said oppositely directed faces for receiving said circuit boards, and an elongated circuit board receiving cavity extending through said housing from one of said faces to the other of said faces;

a transverse passage extending through said housing and intersecting said cavity;

a plurality of electrical terminals within said cavity for electrically contacting conductors on said circuit boards;

means for supporting said terminals in spaced relation along opposing side walls within said cavity and opening to at least one of said faces at said elongated opening to permit insertion of said terminals; and a terminal engaging pin for insertion through said transverse passage and between terminals on said opposing side walls, for engaging each of said terminals and holding said terminals in place within said connector housing.

2. The connector of claim 1, wherein said means for supporting said terminals comprises a plurality of unformly-spaced ledges formed on said opposing side walls within said cavity, said ledges forming with said opposing side walls a slot for receiving each of said terminals.

3. The connector of claim 2, wherein said elongated opening on one face communicates with said elongated opening on the other face to form said circuit board receiving cavity.

4. The connector of claim 3, wherein said transverse passage receives said terminal engaging pin so that said pin passes through the length of said cavity and extends across said cavity between said opposite side walls, and acts as a stop so that the circuit boards abut said pin when fully inserted into the connector.

5. The connector of claim 4, wherein each of said terminals has a dimpled portion and wherein said terminal engaging pin engages each of said terminals at said dimpled portion and biases said terminals outwardly toward said opposing side walls so that said terminals remain fixed upon insertion of the circuit boards into the connector.

6. The connector of claim 5, wherein each of said terminals has two contact ends with the circuit boards contacting the contact ends with a wiping action upon insertion of the circuit boards into the connector.

7. A connector for receiving confronting edges of two coplanar circuit boards and electrically interconnecting a conductor on one of said circuit boards with a conductor on the other of said circuit boards, said connector comprising:

a one-piece connector housing having an opening on each of two oppositely directed faces thereof, said openings communicating to form a circuit board cavity into which the edge of one of said circuit boards is inserted at each of said oppositely directed faces;

a passage extending transversely through said housing and intersecting said cavity;

a plurality of terminals within said cavity, each of said terminals for making contact with and electrically interconnecting a conductor on each of said printed circuit boards inserted into said cavity;

means formed on opposing walls within said cavity for supporting said terminals so that some of said terminals are arranged in spaced relation along one of said opposing walls and the others of said terminals are arranged in spaced relation along the other of said opposing walls; and a terminal engaging pin for insertion through said passage, said pin being inserted between said terminals on one of said opposing walls and said terminals on the other of said opposing walls in order to maintain the terminals fixed on said opposing walls so that upon insertion of circuit boards into said openings, said terminals on one of said opposing walls contact conductors on one side of the circuit boards and said terminals on the other of said opposing walls contact conductors on the other side of the circuit boards.

* * * * *